United States Patent [19]

Frentzel et al.

[11] 4,381,811

[45] May 3, 1983

[54] SUPPORT CARRIER FOR THE DRIVE SHAFT OF A VERTICAL VENETIAN BLIND

[75] Inventors: Kurt H. Frentzel, Zevenhoven; Herman Oskam, Bergambacht, both of Netherlands

[73] Assignee: Hunter Douglas International N.V., Willemstad, Netherlands Antilles

[21] Appl. No.: 136,952

[22] Filed: Apr. 3, 1980

[30] Foreign Application Priority Data

Apr. 6, 1979 [DE] Fed. Rep. of Germany ..... 2913886

[51] Int. Cl.[3] ..... E06B 9/36

[52] U.S. Cl. ..... 160/168 R; 160/172; 160/178 R

[58] Field of Search ..... 160/196 D, 166, 167, 160/168, 169, 178 R, 340, 345, 171, 172, 173, 166 A, 168 R

[56] References Cited

U.S. PATENT DOCUMENTS 3,054,446 9/1962 Cayton ..... 160/173
3,190,346 6/1965 Arena et al. ..... 160/172
3,500,896 3/1970 Endou ..... 160/173
4,267,875 5/1981 Koks ..... 160/168 R

FOREIGN PATENT DOCUMENTS 2396151 6/1977 France .
1323291 7/1973 United Kingdom ..... 160/166 A

*Primary Examiner*—John E. Murtagh
*Assistant Examiner*—Cherney S. Lieberman
*Attorney, Agent, or Firm*—Pennie & Edmonds

[57] ABSTRACT

A support carrier for the drive shaft of a vertical venetian blind is disclosed for supporting the drive shaft intermediate its ends, particularly when the blind is open. The support carrier moves along the drive shaft to a predetermined stop point so that a number of support carriers may be used if necessary positioned at various points along the drive shaft. The drive shaft moves the support carrier through a slip clutch engaged with the drive shaft, which clutch is a disk in slideable engagement with the facing inner surfaces of the casing walls of the support carrier.

10 Claims, 4 Drawing Figures

335
336
334

320
320a
11
320a
322
321
324
321b
321c
321a
323
327a
333a
327b
327
325
328
333
333b
329a
329
329b
330
340
331
332

320
324
330
329b
333
329
329a
328
321
16
15
323
328
333
331
330
327
320

SUPPORT CARRIER FOR THE DRIVE SHAFT OF A VERTICAL VENETIAN BLIND

BACKGROUND OF THE INVENTION

1. Field of the Invention

The invention relates to louvered venetian blinds, particularly vertical venetian blinds, having several types of carriers which may be shifted along a headrail and through which carriers a drive shaft passes, which drive shaft has at least one helical groove. The carriers may include louver carriers with one louver carrier for each louver as well as pull carriers for traversing axially of the drive shaft and arranging the louver carriers either evenly distributed over the face of the window or arranged in packs of louvers at the sides.

The types of carriers may also include support carriers for preventing the sagging of the drive shaft in those areas of the shaft where there is no louver carrier or pull carrier. Preferably, the support carriers may be individually retained at predetermined points along the headrail by use of stops provided on the rail.

2. Prior Art

In one known type of venetian blind, the louvers can be turned (without axial traverse or transport) about their vertical axes through an angle of more than 150° by means of the drive shaft. When it is desired to use support carriers in such a type of venetian blind, which carriers are transported by means of the drive shaft, great disadvantages can occur in practice if the support carrier is permitted to traverse axially of the drive shaft during the time that the drive shaft is rotating the louvers about their vertical axes. If this occurs, the support carrier may run up against the first louver carrier or a pull carrier, thus applying an axial transport force against the first louver carrier or pull carrier which is undesired. In such blinds, the support carriers are only connected frictionally to the drive shaft. However, the transport action exerted in the axial direction of the shaft upon the support carrier is, nevertheless, of such a magnitude that undesired transport of the support carrier (and ultimately of the next adjacent louver carrier or pull carrier) can take place.

BRIEF SUMMARY OF THE INVENTION

It is the object of the present invention to provide a support carrier which may be transported axially of the drive shaft to provide the requisite support at predetermined points, in which such axial transport is completely avoided during rotation of the louvers by the drive shaft.

To this end, the invention provides a pull carrier for transport of the louver carriers, which pull carrier has a free wheel mechanism which insures against axial transport of the pull carrier by the drive shaft during turning of the louvers about their vertical axes. A slip clutch is provided for each support carrier disposed between the support carrier and the drive shaft. In order to secure the pull carrier against axial transport or traverse during the turning of the louvers, a braking device is provided on the pull carrier, which braking device interacts with the rail upon activation by a support carrier.

Accordingly, the invention insures that the pull carrier remains stationary during rotation of the louvers due to two factors. First of all, during the rotation of the louvers, the force from the drive shaft applied to the pull carrier is dissipated by the free wheeling mechanism. Secondly, in the event that a drive shaft support carrier runs up against a pull carrier, then, in that event, the support carrier activates the braking device on the pull carrier to brake the pull carrier against the rail and insure that it remains stationary.

The braking device comprises a wedge-shaped member pivoted on the pull carrier with the sloped surface of the wedge being engaged by a portion of the support carrier, thus forcing the wedge in a vertical direction against the rail, wedging it there and, thus, preventing movement of the wedge and its associated pull carrier.

In effect, the wedge surface transforms the horizontal force component, which would otherwise by applied by the run up of the support carrier, into a vertical force component which serves to brake the pull carrier firmly against the rail. Still further, the support carrier itself includes a clutching-type device which, upon braking the pull carrier, greatly reduces the horizontal (axially of the drive shaft) force applied to the support carrier and through it to the pull carrier. Preferably, there is one wedge-shaped braking member on each side of the pull carrier, both of which are engaged by portions of a support carrier, when a support carrier runs up to a pull carrier.

According to the invention, it is further proposed that the wedge piece is provided, on its side directed towards the louver carriers with a stop which when contacted with a contacting surface causes the wedge surface to be held in the proper operational position.

This is advantageous when the venetian blind is closed. The free end of the wedge surface of the wedge piece is then always at such a height that the support carrier can run over or underneath the wedge surface, dependably whether the wedge piece is mounted with the wedge surface and nose on the lower- or upperside. Both arrangements being equally effective.

Advantageously, the stop can here be formed by a resilient nose piece which is joined to the wedge piece only in the upper or lower zone of the latter (as the case may be) and extends approximately vertically.

Additionally, it was also an object of the invention to provide a support carrier of a louvered venetian blind in which, in the event of possible running-up onto an obstacle (such as a pull carrier) the axial drive forces exerted on the pull carrier are as small as possible. The smaller these axial drive forces, the lower the jamming forces can be to effectively activate the wedge surface and the more readily can the jamming forces be released when the transport of louver and pull carriers in the axial direction starts anew.

To achieve this object, the slip clutch provided in the support carrier is a friction clutch and comprises a disk which engages with a part of its cross-section in the drive shaft and which is arranged between, and in direct contact with, the two walls of the carrier casing, which extend transversely to the drive shaft. The thickness of the disk in the axial direction is somewhat larger than the clear spacing between the walls of the carrier casing.

The magnitude of the particular desired axial drive force and the magnitude of the required safety margin, determine by how much the thickness of the disk is made greater in the axial direction than the distance between the walls. The magnitude of the friction force to be transferred can be determined by the disk diameter chosen.

This friction clutch has the additional advantage that it is very short in the axial direction of the support carrier. For this reason, the support carrier itself can also be sized to be very narrow. The support carriers must take over the support of the drive shaft in the zone free from louver carriers when the louvered venetian blind is partially or completely open.

DETAILED DESCRIPTION OF THE INVENTION

General Description of the Blind

Figure 1:
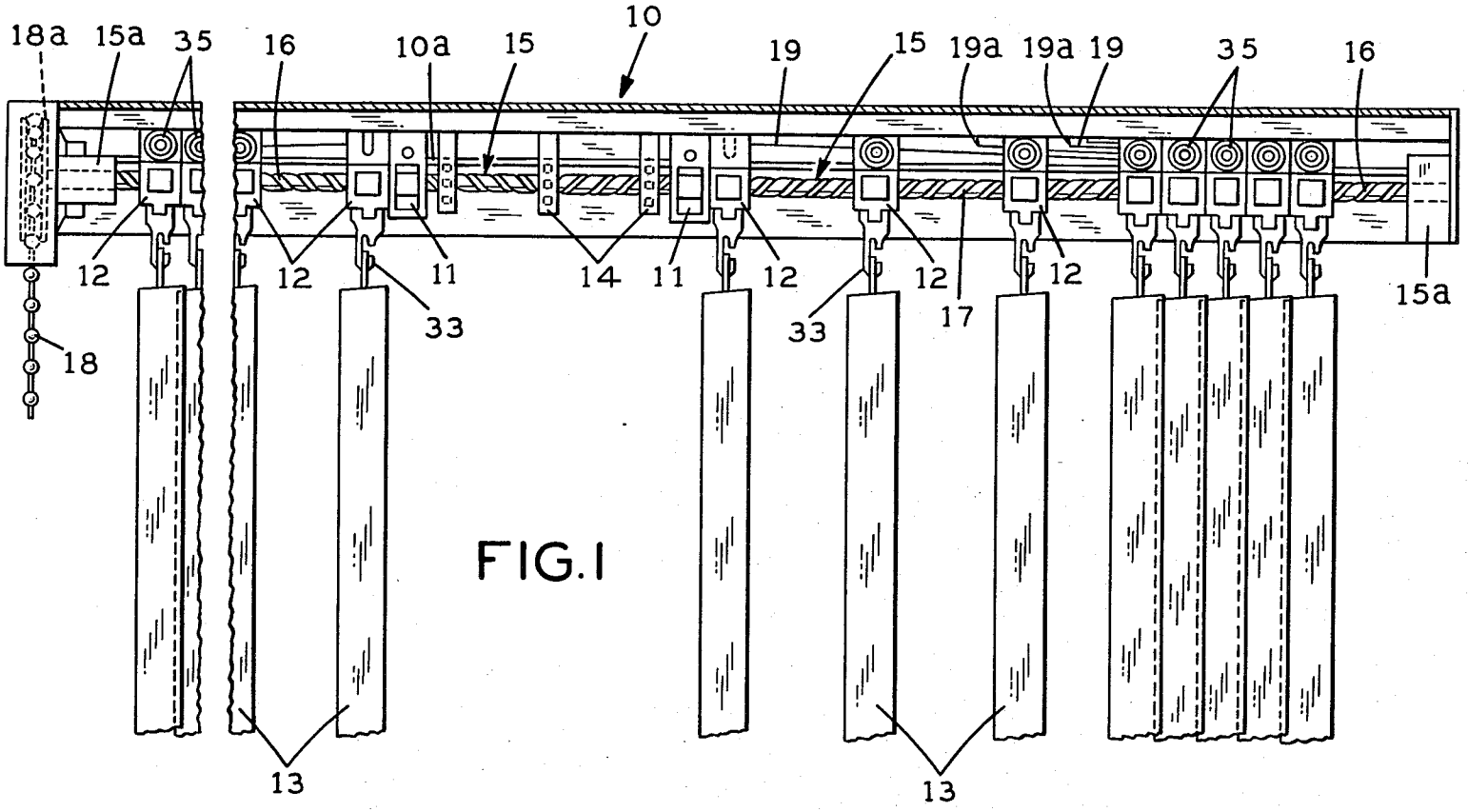
FIG. 1 shows a side view of a vertical louver venetian blind with portions of the headrail in cross-section.

As shown in FIG. 1, the vertical louver venetian blind comprises a headrail 10 having on either side thereof on the inner side of the walls spaced tracks 10*a*, only one of which is shown in FIG. 1. Supported from these tracks 10*a* by rollers 35 are a plurality of carriers 12, each of which carriers a louver 13 suspended therefrom by a louver holder or hook 33 extending downwardly from and mounted for rotation in the carrier 12.

As is most commonly utilized in practice, the louvers 13 and their associated carriers 12 are arranged in two packs, one to the left and one to the right which, when the blind is closed, meet at the center and, when the blind is open, are packed together in two packs, one at the left end and one at the right end of the rail 10.

A drive shaft 15 is mounted within the headrail 10 by means of bearing blocks 15*a* at or adjacent the ends of the shaft 15 and also by means of intermediate support carriers 14 through which the drive shaft 15 extends. The intermediate support carriers 14 are provided in order to prevent any sagging of the drive shaft 15. The drive shaft 15 also extends through a pair of pull carriers 11, one of which is associated with each of the two packs of louver carriers 12. The drive shaft 15 has three helical grooves. The grooves 16 on one-half of the shaft 15 are opposite to the grooves 17 on the other half of the drive shaft 15. Each of the pull carriers 11 has within it means for engaging the three helical grooves 16 or 17 in the drive shaft 15 for sliding engagement along the drive shaft upon rotation thereof. The details of this mechanism are described below. As will be apparent from FIG. 1, upon rotation of the drive shaft 15, one of the pull carriers 11 (the one to the right in the figure) will move to the right away from the other pull carrier 11 (the one to the left) which will move to the left due to the different and opposite direction of the three helical grooves 16 with respect to the three helical grooves 17. Each of the pull carriers 11 is also connected securely to the first adjacent carrier 12 of its associated pack of carriers 12. Accordingly, when the pull carriers 11 move from the center toward the ends of the headrail 10, they will carry with them the first associated carrier in each pack until they reach the next carrier, at which point they will carry both the first and second carrier 12 along with them until they reach the third carrier 12 and move it along as well and so on, picking up each carrier in succession and moving it toward the end, thus opening the blind. When the drive shaft 15 is driven in the opposite direction, the pull carrier 11 and the first louver carrier 12 to which it is secured will be moved from the end position toward the center position. When pull carrier 11 and its connected louver carrier 12 have moved together toward the center a predetermined distance, the carrier 12 will engage the end 19*a* of a spacer member 19. Each of the louver carriers 12, except for the first ones which are connected to the pull carriers 11, has secured thereto at one end an elongated metal strip 19 which extends to and through the next adjacent louver carrier 12 toward the center. This elongated metal spacer strip 19 determines the spacing between adjacent louver carriers 12 and, thus, between the louvers 13. The spacer 19 extends through in sliding relationship with the next adjacent carrier 12 that is on that side toward the center. When a carrier 12 reaches the end of the spacer 19, it engages the up-turned prong 19*a* and, thus, pulls the next succeeding carrier 12 along, which next succeeding carrier 12 is fixed to the opposite end (opposite end 19*a*) of the spacer member 19. In this way, the blind, when closed, insures that the individual louvers 13 are evenly spaced while at the same time permitting them to pack together at the ends when opened.

At one end of the shaft 15 is a bead chain pulley 18*a* secured thereto and around which is engaged a bead chain 18 for operating the blind by rotating the drive shaft 15.

Pull Carrier and Its Free Wheeling and Clutch Mechanism

Figures 2, 3:
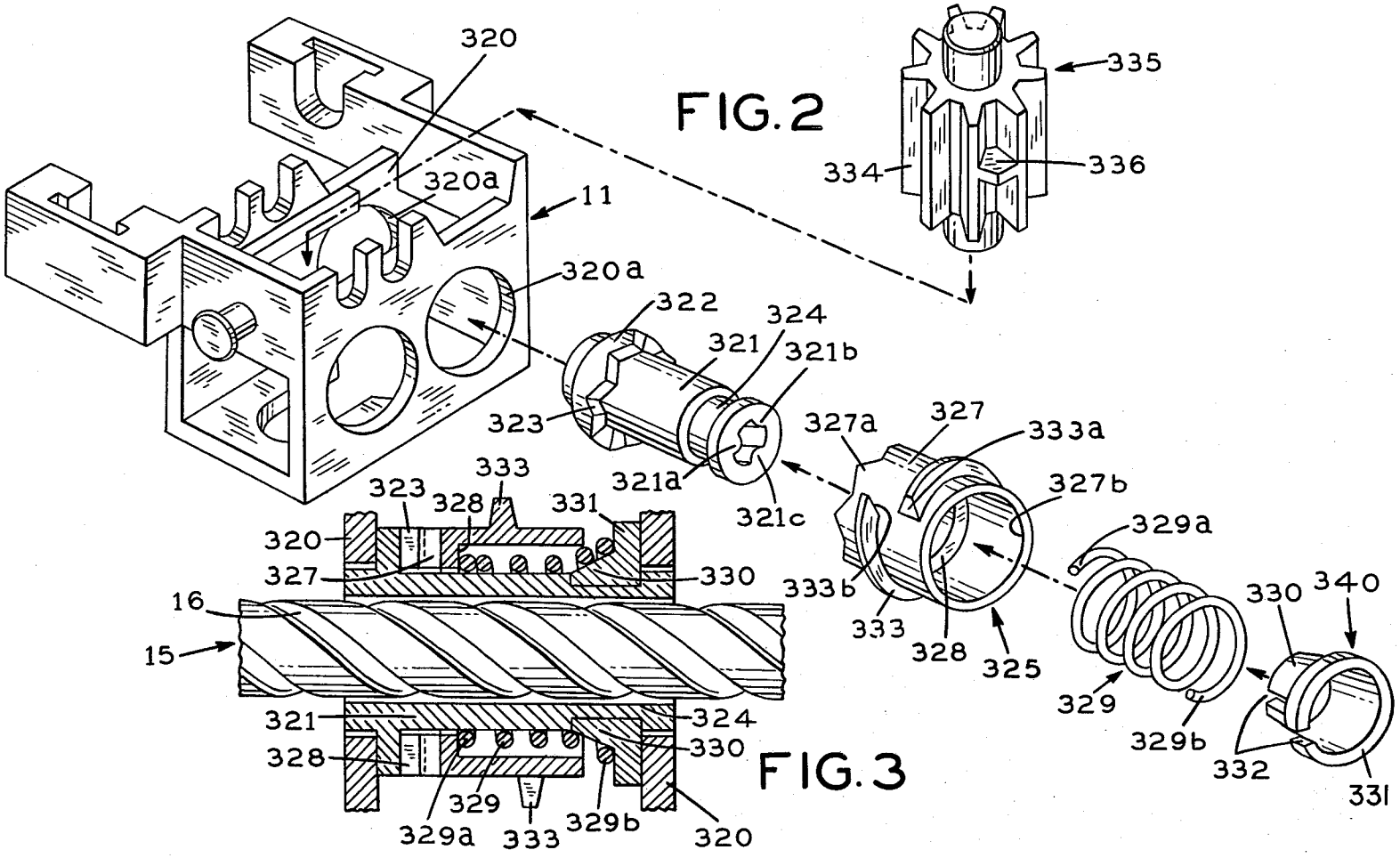
FIG. 2 is an exploded perspective of the pull carrier mechanism.
FIG. 3 is a cross-section through a portion of a fully assembled pull carrier.

With reference now to FIG. 2, it will be seen that the pull carrier 11 has a casing 320 having openings 320*a* through which the drive shaft 15 passes. A sleeve 321 surrounds the drive shaft 15 and, at least at one end, has a shape including three inwardly extending lobes 321*a*, 321*b* and 321*c* which engage in the three grooves 16 of the drive shaft 15, thus, providing a positive connection between the sleeve 321 and the drive shaft 15. At one end, the sleeve 321 has an integral flange 322 having integral teeth 323 extending in an axial direction toward the opposite direction of the sleeve 321. Adjacent its other end, the sleeve 321 has a groove 324. A spring 329 of the coil-type encircles the sleeve 321 and is itself encircled by the hub 327 of a worm 325.

In assembling the parts comprising the free wheeling and clutch mechanism, the worm 325 is first placed over the sleeve 321 concentric therewith and with its teeth 327*a* in engagement between the teeth 323 of the sleeve 321. The worm 325 has a radially, inwardly extending shoulder 328 dimensioned to fit loosely about the sleeve 321. The internal cylindrical wall 327*b* of the hub 327 is sufficiently large to receive coil spring 329 which is itself sufficiently large to encircle the sleeve 321. Accordingly, at the end 329*a* of coil spring 329, the coil spring bears against the shoulder 328 of worm 325.

Positioned within the groove 324 is a flanged journal-like member 340 having a hub 330, a flange 331 and a slot 332 extending parallel to the axis of the journal-like member 340 throughout the length of the hub 330 and the flange 331. As shown in FIG. 3, the hub portion 330 of the journal-like member 340 has a generally conical shape about which is positioned the end 329*b* of the coil spring 329.

By virtue of the engagement of the end 329*a* of the spring 329 against the shoulder 328 while the end 329*b* of the spring 329 is substantially fixed axially, the spring 329 serves to maintain the teeth 327*a* of the worm 325 resiliently but firmly engaged between the teeth 323 of the sleeve 321. At its opposite end 329*b*, the coil spring 329 is engaged about the conical hub 330 and serves to squeeze the journal-like member 340 to reduce the size of the slot 332, thus, maintaining the journal-like member 340 firmly engaged within the groove 324 of the sleeve 321. Accordingly, on the one hand, the coil spring 329 resists disengagement of the journal-like member 340 from the groove 324 by tending to ride ever further upward on the conical surface of hub 330, thus, affecting a squeeze action to further insure engagement of the journal-like member 340 with the groove 324. On the other hand, and simultaneously, the end 329*a* bears against the shoulder 328 of the worm 325 serving to insure engagement of the teeth 327*a* between the teeth 323 of the sleeve 321.

Operationally, rotation of the drive shaft 15 effects rotation of the sleeve 321 due to the engagement of the lobes 321*a*, 321*b* and 321*c* with the helical grooves 16 of the drive shaft 15. Rotation of the sleeve 321 effects rotation of the worm 325, coil spring 329 and journal-like member 340 due to the engagement of the teeth 323 on sleeve 321 with teeth 327*a* on worm 325. This rotation also rotates worm thread 333. Worm thread 333 is in engagement with teeth 334 of a gear 335. Gear 335 rotates nothing. Its sole purpose is to serve as a timing or position controller and, to this end, it has a stop 336 positioned between two adjacent teeth 334.

When drive shaft 15 is operated, worm 325 will be rotated as above described and gear 335 will be rotated due to engagement between the worm thread 333 and the teeth 334. This comprises a free wheeling rotation in which no actual work is accomplished. Eventually, either the face 333*a* or the face 333*b* (depending upon the direction of rotation) will come into engagement with the stop 336. At this point, the engagement between the lobes 321*a*, 321*b* and 321*c* of the sleeve 321 with the grooves 16 will cause the sleeve 321 to move along the drive shaft 15, either to the left or to the right depending upon the direction of rotation. This transport of the sleeve 321 effects traverse of the entire pull carrier 11 due to the engagement of the flange 322 at one end and the flange 331 at the other end of the sleeve 321 with the walls of the carrier 320.

During the time when the drive shaft 15 is rotating and carrying with it the sleeve 321, worm 325, coil spring 329 and journal-like member 340, the pull carrier 11 will remain stationary. However, during this time mechanism within the louver carriers 12, which mechanism is not shown, will be rotating the louvers 13. These louvers 13 will complete their rotation in one direction or the other shortly before one or the other faces 333*a*, 333*b* of the worm thread 333 engages the stop 336. Accordingly, rotation about their vertical axes is assured for the vertical louvers while at the same time lateral transport or traverse is prevented. However, shortly after the louvers reach their limits of rotation in either direction, but not before, one of the faces 333*a*, 333*b* of the worm thread 333 will come up against the stop 336 whereupon traverse of the pull carrier 11 will commence.

Lateral movement (traverse) of the pull carrier 11 carries with it the first louver carrier 12 to which it is secured. When the movement is in the direction to open the blind, this movement of the pull carrier 11 and its associated louver carrier 12 is a movement away from the center of the window, which movement soon brings the first louver carrier 12 into contact with the next adjacent louver carrier 12, thus, causing it to move axially along the drive shaft as well. As this movement continues, each succeeding louver carrier 12 is "picked up" and moved along with the pack until all of the louvers are assembled together at the lateral edge of the window.

At this point, further operation of the drive shaft 15 can no longer move either the pull carrier 11 or the louver carriers 12 since they have already been drawn together in a pack and the last of which is bearing against a stop. Accordingly, further force applied in this direction to the drive shaft 15 will be imparted to the sleeve 321 which will attempt to continue to rotate. This attempt at continued rotation overcomes the bias of the spring 329 and causes the teeth 323 to slip over the teeth 327*a* providing a clutching action. When an operator hears these teeth snapping over one another, he knows that the pull carrier associated therewith has reached the limit of its movement. The other pull carrier, however, may not yet have quite reached its limit. If this is the case, the operator will continue rotation of the drive shaft 15 in the same direction until the second pull carrier also begins to exhibit the snapping noise associated with having reached its limit as the teeth 327*a* and the teeth 323 slip past each other. When both pull carriers 11 are exhibiting this action, then, at that point, the venetian blind has reached the limit of its outward opening capacity. Also, at this point, both packs of blinds 13 will have been assembled in the tightest possible pack on either side of the window.

If now the drive shaft is rotated in the opposite direction, then, in that event, no further force will be applied tending to make the teeth 327*a* and the teeth 323 slide over each other. To the contrary, free wheeling rotation of the worm 325 and the gear 335 will now again take place. At the same time, the mechanism within the louver carriers 12 will commence rotation of the louvers 13 about their vertical axes. Continued rotation of the shaft 15 in this other direction will continue to rotate the louvers about their vertical axes until, again, they reach their limit (although in the opposite direction). Shortly after the mechanism for rotating the louvers about their vertical axes reaches its limit of rotation in this other direction, one of the faces 333*a* or 333*b* will come into contact with the stop 336 and begin traverse of the carrier 11 in the opposite direction, such as towards the center.

This movement of the pull carriers 11 toward the center carries along the first louver carrier 12 in each pack. Shortly, however, each louver carrier 12 comes up against a stop 19*a* on spacer member 19 which causes the spacer member 19 to move along with the louver carrier 12. At its end opposite to the stop 19*a*, each spacer 19 is fixed to the next succeeding louver carrier 12. Accordingly, the next succeeding louver carrier 12 will be pulled along by its associated spacer 19 and the preceding louver carrier 12 until the louvers are spread out in the desired spaced relationship across the window. Again, when one of the pull carriers 11 has reached its traverse across the center, it will come up against a suitable stop which may be the other louver carrier 11, a support carrier 14, or a special stop provided for the purpose. Having reached its limit of traverse, the pull carrier 11 cannot move further even upon further rotation of the shaft 15. Rather, further rotation of the shaft 15 causes the declutching effect previously described between the teeth 323 and the teeth 327*a*. If both pull carriers 11 have not arrived simultaneously at the center, one will reach it first and rotation of the shaft 15 will effect the slipping over of the teeth 327*a* with respect to the teeth 323 which the operator will hear. He will then continue operation until this ratching sound has occurred at both pull carriers 11 whereupon he will stop rotation of the shaft 15.

Not only may the vertical louvers be adjusted about their vertical axes at the two extreme positions of the blind (open and closed) but, also, the louvers may be adjusted about their vertical axes at any intermediate point between these two extremes. However, when the limit of rotation of the louvers about their vertical axes is reached in either direction, then, in that event, the pull carriers 11 will begin to traverse along the axis of the shaft 15.

To insure the proper timing of the traverse of the pull carriers 11 in order to avoid any overlap with rotation of the louvers about their vertical axes, the worm 325 and the gear 335 ratio is selected to be different from the ratio of a similar worm and gear provided for each louver. For example, at each louver carrier, the drive shaft 15 may be provided with a worm similar to worm 325 and of the same pitch. Similarly, the louver carrier 12 can be provided with a gear similar to gear 335 engaged with its cooperating worm and supporting the louver for rotation about its vertical axis. Gear 335 may have eight or nine teeth while the analogous gear for the louver carrier 12 may have five or six teeth. With such an arrangement, the gear for supporting and rotating the louvers will complete its range of rotation with less rotation of the drive shaft 15 than will the gear 335. This difference allows the louvers to be turned to their limit in either direction prior to engagement of the stop 336 by one of the faces 333*a*, 333*b* of the worm 325.

The Pull Carriers

Figure 4:
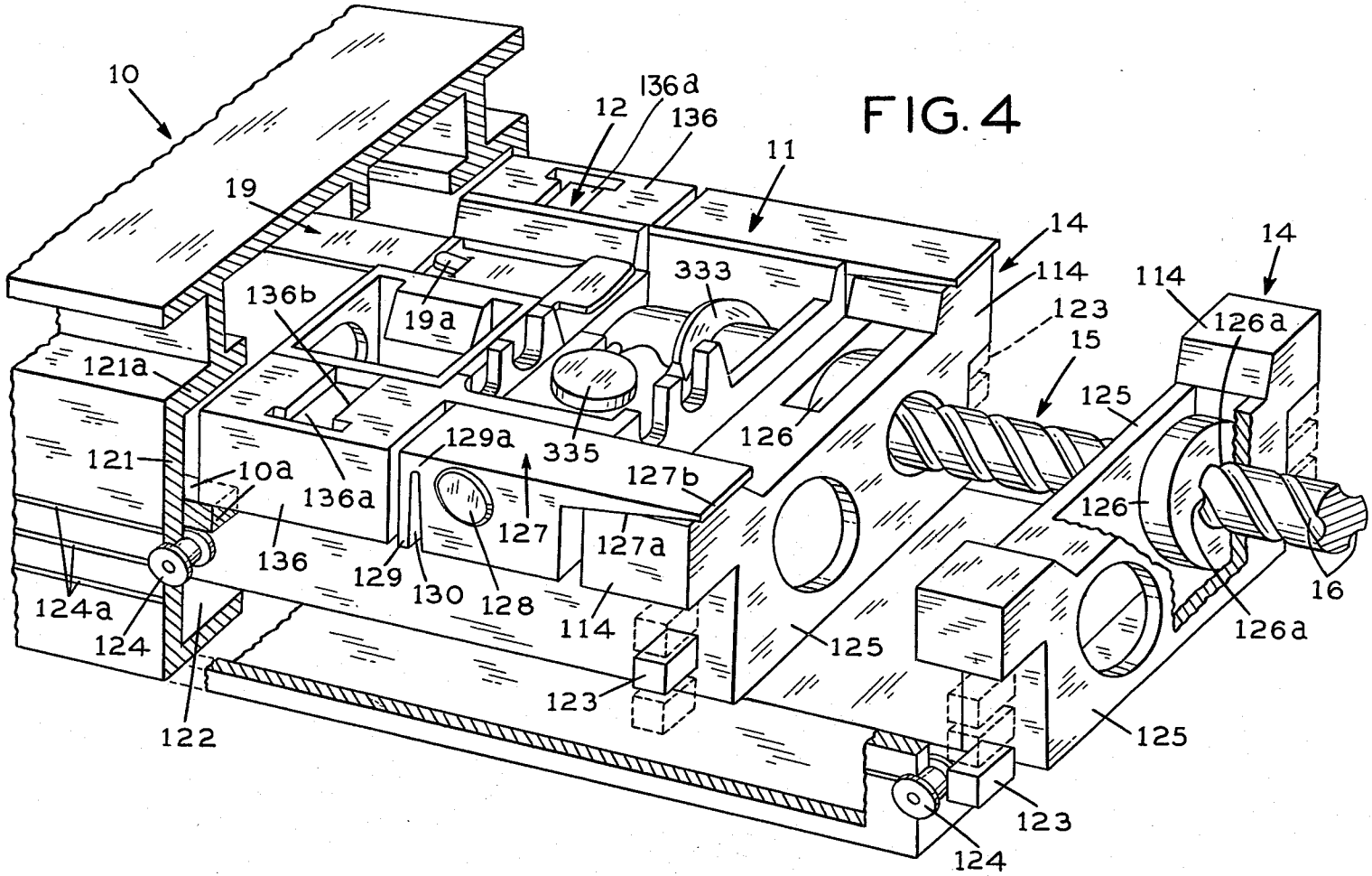
FIG. 4 is a perspective of a portion of a headrail, showing one pull carrier secured to the first adjacent louver carrier and also showing two drive shaft support carriers.

As will be seen from FIG. 4, the track 10*a* divides the rail 10 into an upper portion 121 and a lower portion 122. In the portion 122, stops 14 are provided at selected locations. These stops 124 are inserted at different heights to interact with stops 123 projecting laterally from the support carriers 14. One stop 124 in the lower portion 122 of the rail 10 and one laterally projecting stop 123 on a support carrier 14 cooperate in each case to selectively stop each individual support carrier 14 during opening of the blind. The particular point at which each support carrier 14 is stopped during opening of the blind is determined by one of its stops 123 cooperating with a stop 124 in the rail 10, which, stop 124 must be at the same height as the stop 123. Each support carrier 14 initially has three stops 123 on each side. Those stops 123 which are not required for any given support carrier 14 are removed upon assembly of the blind. As shown in FIG. 4, the removed stops are indicated in dashed lines. It will be noted that for the two support carriers 14 shown in FIG. 4, the three stops 123 on the side away from the viewer have all been removed in both instances. Moreover, in FIG. 4, two of the three stops on the side of each of the carriers 14, which face the viewer in FIG. 4, have also been removed. This leaves one stop on each of the carriers 14 as shown. The remaining stops 123 are in both instances on the side of the support carrier 14 which faces the viewer in FIG. 4. In one instance (the left-hand support carrier 14), the remaining stop 123 is the middle one. This stop 123 on the left-hand support carrier 14, thus cooperates with the stop 124 to the left in FIG. 4. On the support carrier 14 to the right in FIG. 4, the sole remaining stop 123 is the bottom one of the three on the side facing the viewer. This stop 123 remaining on the right-hand support carrier 14 cooperates with the stop 124 that is to the right in FIG. 4. It will be seen that in this way the support carrier 14 that is to the left in FIG. 4 has been able to pass by the stop 124 that is to the right in FIG. 4 since its stop 123 is positioned above the right-hand stop 124. Accordingly, the left-hand support carrier 14 will not be stopped by the right-hand rail stop 124 but, rather, by the left-hand stop 124, which is in alignment with it. Three grooves 124*a* at different levels in the outer wall of the rail 10 may be provided. These grooves 124*a* indicate the location of the upper, middle and lower stops 123 on the support carriers 14 in order to aid in placement of the stops 124. At the same time, the grooves 124*a* provide an esthetic decoration for the rail.

It will be seen that by this arrangement with three potential stop points on each side of each support carrier 14, that six different stops 124 may be provided along each half of the drive shaft 15. That is, to say, that from the center of the drive shaft 15 to the left, six different support carriers can be provided each with a different stop point; and, similarly, six different support carriers 14 may be provided to the right of the center, each having its own individual stop point.

The support of the drive shaft 15 by the support carriers 14 is usually most necessary when the blind is open. In the open position of the blind, all the louvers and their associated louver carriers together with one associated pull carrier for each pack are arranged at the extreme left and right of the window and of the drive shaft. It is at this time that the intermediate support which can be provided by the support carriers 14 is most necessary. When the blind is closed and the two packs of louvers meet at the center of the blind and are spread over the length of the drive shaft, the distribution is such that the louver carriers readily prevent any sagging of the drive shaft and, as such, the support carriers are accumulated at the center between the two pull carriers.

Each support carrier 14 has laterally extending ears 114 which engage the rail 10*a* in sliding relationship. Each support carrier 14 also has two spaced vertical walls 125 extending transversely of the drive shaft 15. A disk 126 has three inwardly extending cam-like members 126*a* which engage in the three grooves 16 of the drive shaft 15. The two axial end faces of the disk 126 bear against the inner surfaces of the casing walls 125. This engagement provides a contact or frictional pressure of predetermined magnitude which is determined by the thickness of the disk 126 in its axial direction, which thickness is somewhat larger than the clear space between the facing inner surfaces of the casing walls 125. The total magnitude of the friction between the disk 126 and the adjacent walls 125 is, in part, determined by the disk 126; in part, by its diameter and also by the elasticity and the nature of the surface of the materials which are in contact with one another.

The disk 126 represents a slip clutch. On rotation of the drive shaft 15, there will be an initial transport or traverse of the support carrier 14 axially of the drive shaft until the carrier 14 strikes an obstacle. As soon as the support carrier 14 strikes an obstacle, the force emanating from the disk 126 will become so large that the friction between the disk 126 and its adjacent casing walls 125 is overcome, thus permitting rotation of the disk 126 with respect to the casing walls 125. The drive shaft 15 may, therefore, continue to rotate even when the support carrier runs up on an obstacle.

The two pull carriers 11 each have on each side thereof a wedge piece 127 with a downwardly facing wedge surface 127*a*. The wedge piece 127 is pivotable about the horizontal axis of a stud 128 extending transversely of the drive shaft 15 and outwardly of the pull carrier 11. On its side facing the next louver carrier 12 (the first louver carrier 12) the wedge-shaped piece 127 has a nose 129 separated by a gap 130 from the major body portion of the wedge 127. As shown, the nose piece 129 is joined to the rest of the wedge piece 127 only in the upper region 129*a*. This design provides the nose piece 129 with a given resiliency due, in part, to the inherent resiliency of the plastic from which the piece 127 is molded and, in part, to the gap 130.

The pull carrier 11 has rearwardly extending lateral projections 136 engaged in the upper portion 121 of the rail 10 and resting in sliding relationship to the track 10*a*. These projections 136 embrace the first louver carrier 12 with one projection 136 being positioned on each side of the first louver carrier 12. Each louver carrier 12 has laterally extending studs 136*a* which would normally receive a wheel, such as wheel 35 as shown in FIG. 1, for rolling engagement on the track 10*a* and where the louver carrier is not connected to a pull carrier. However, as shown in FIG. 4, the studs 136*a* of those louver carriers connected to a pull carrier are engaged in an opening 136*b* of the embracing projections 136 of the pull carrier 11.

The nose 129 of the wedge piece 127 rests against the adjacent surface of the projection 136 in such a manner as to hold the wedge piece 127 upwardly in a resilient manner, such that the wedge-shaped piece 127 is at its greatest possible height. This insures that the support carrier 14 next adjacent to the pull carrier 11 does not run up against the edge 127*b* of the wedge piece 127 but, rather, will slide therebeneath engaging with the downwardly facing sloped surface 127*a*.

Operation

As long as the worm 325 can also rotate the free wheeling gear 335 during rotation of the drive shaft 15, no axial transport of the pull carrier 11 will take place. Meanwhile, the rotary motion of the drive shaft 15 in the individual louver carriers 12 serves to rotate the louvers 13 about their vertical axes. In one of the two possible directions of rotation of drive shaft 15, support carriers 14 can also be transported in that axial direction which corresponds to its approach to a particular pull carrier 11. This results in the support carrier 14 that is next to the temporarily stationary pull carrier 11 passing underneath the wedge piece 127. The force of the drive shaft 15 applied to the support carrier generates a horizontal force component by which the support carrier 14, and more particularly its lateral ears 114, are jammed between the track 10*a* and the wedge piece 127 which is, in turn, wedged between the lateral ears 114 and the upper web 121*a* which parallels track 10*a*. This jamming in effect transforms the horizontal force of the drive shaft on carrier 14 into a vertical force acting on wedge 127. In this manner, further axial motion of the support carrier 14 along the drive shaft 15 is positively arrested. The friction clutch formed by the casing walls 125 and the disk 126 now becomes active since the drive shaft 15 will rotate the disk 126 which will now slide frictionally within the walls 125 without moving along the shaft 15.

Due to this action of the friction clutch comprising the disk 126 and the walls 125, there remains very little axial driving force component tending to move the support carrier 14 along the drive shaft 15. Accordingly, the jamming force of the ears 114 with respect to the wedge face 127*a* and the track 10*a* is similarly small. As a result, the amount of force necessary to release the jammed condition and move the support carrier 14 in the opposite direction is also correspondingly small.

When the support carrier 14 next adjacent to the pull carrier 11 is wedged between the track 10*a* and wedge face 127*a*, the forces applied, though small, are sufficient to prevent axial movement of the support carrier 14 along the drive shaft even if one or more additional support carriers 14 should run up against the first mentioned support carrier 14, which is in jammed-braked condition. This force is also, though still small, sufficient to secure the pull carrier 11 against axial transport during turning of the louvers 13 about their vertical axes by means of the drive shaft 15.

However, upon completion of rotation of the louvers 13 about their vertical axes, continued rotation of the drive shaft will bring one of the faces 333*a* or 333*b* of the thread 333 up against stop 336. Thereupon, continued rotation of the drive shaft 15 will cause the pull carrier 11 to move along the drive shaft 15 in a direction away from the adjacent support carrier 14. This movement along the shaft 15 unjams the wedge 127 sufficiently to permit movement of the support carrier 14 along the drive shaft 15 in the same direction. This movement of pull carrier 11 (with its fixed louver carrier 12) and the support carrier 14 continues until the stop 123 on support carrier 14 comes up against its corresponding stop 124. This traverse of the carriers continues until the blind is completely open and all of the support carriers 14 have been distributed along the drive shaft 15 at predetermined invervals determined by the contact of stops 123 with stops 124.

When the drive shaft is now rotated in the opposite direction, the vertical louvers of the blind will be rotated about their vertical axes and, substantially simultaneously, the support carriers 14 will move along the drive shaft 15 toward the center thereof. The pull carrier 11 for each pack of louvers will remain stationary with its worm 325 rotating and effecting rotation of gear 335 until the other face 333*a* or 333*b* of worm 333 contacts stop 336 (which occurs only after complete rotation of the louvers 13) whereupon movement of the pull carriers 11 toward the center commences as previously described.

Various modifications will be apparent to those skilled in the art. For example, the wedge piece 127 is shown as operating in such a manner that its wedge surface 127*a* extends over the top of the lateral ears 114 of the support carrier 14. It is equally possible to invert the wedge piece 127 so that the resilient motion 129 holds the wedge piece down into contact with the track 10*a* with a consequent wedging action on the lateral ear 114 of a support carrier 14, to wedge the same against movement between the, now, upwardly facing sloped surface 127*a* (held against the track 10*a* by gravity and the nose piece 129) and the upper overlying parallel member 121*a*. Such a modification has not been shown in the drawings since it merely involves inversion of the member 127.

It is preferred that most of the elements of the carriers be made from injection molded plastic with the exception of the spring 329, drive shaft 15 and headrail 10. The particular plastic selected will depend upon its characteristics and the function required of it. For example, the intermediate support carrier 14 must be of a plastic that will exhibit some resiliency in its walls 125.

We claim:

1. In a louvered venetian blind having vertical louvers, a headrail, a plurality of louver carriers mounted on said headrail for movement therealong, a drive shaft mounted in said headrail, support carriers mounted in said headrail for movement therealong and driveable by said drive shaft and said support carriers supportingly engaging said drive shaft, the improvement comprising: at least one pull carrier driveable by said drive shaft for moving said louver carriers along said headrail to open and close said blind; said pull carrier being positioned to be engaged by a support carrier upon movement of said support carrier in one direction along said headrail; and cooperating means on said pull carrier, said support carrier and said rail to brake said pull carrier against movement along said rail upon engagement of said pull carrier by said support carrier.

2. The venetian blind according to claim 1, in which said cooperating means includes:

(a) a sloped surface on said pull carrier;

(b) at least one rail engaging member on said support carrier longitudinally aligned with said sloped surface; and (c) spaced members in said headrail;

said sloped surface and said rail engaging member being positioned between said spaced members in said headrail, said rail engaging member when said support carrier is moved along said headrail by said drive shaft contacting said sloped surface; and said sloped surface and said rail engaging member when mutually engaged becoming jammed between said spaced members to brake said pull carrier against movement.

3. The venetian blind according to claim 2, in which said sloped surface is one surface of a wedge pivotally mounted on said pull carrier on one side thereof.

4. The venetian blind according to claim 3, in which said wedge piece has its sloped surface facing generally toward a rail engaging member of said support carrier, a resilient stop on said wedge piece, and said resilient stop being positioned on the opposite end of said wedge piece from said sloped surface.

5. The venetian blind according to claim 4, in which said resilient stop is positioned to engage a portion of a louver carrier mounted in said headrail.

6. The venetian blind according to claim 5, in which said resilient stop is joined to said wedge piece only adjacent one end of said resilient stop.

7. The venetian blind according to claim 1, in which said support carrier includes a slip clutch, said drive shaft has at least one helical groove therealong, said slip clutch embracing said drive shaft, and said slip clutch having a cam-like member in engagement with said helical groove.

8. The venetian blind according to claim 7, in which said slip clutch comprises a disk, said support carrier has two spaced walls extending transverse to said drive shaft, and each of the opposite faces of said disk is in slideable engagement with the inner surface of one of said walls.

9. The venetian blind according to claim 8, in which the thickness of said disk is at least slightly larger than the clear space between the inner surfaces of said walls.

10. The venetian blind according to claim 9, in which upon rotation of said drive shaft the engagement between the cam-like member on said slip clutch and said helical groove effects movement of said disk and said support carrier along said drive shaft; and said disk sliding with respect to said transverse walls when said support carrier engages said pull carrier to brake said pull carrier and said support carrier against further movement along said rail.

* * * * *